United States Patent [19]

Clark

[11] Patent Number: 4,752,760

[45] Date of Patent: Jun. 21, 1988

[54] ELECTRICAL DEVICE END CAP CONNECTION ASSEMBLY USING RIGID SEALING MATERIAL

[75] Inventor: Daren A. Clark, Centralia, Mo.

[73] Assignee: A. B. Chance Company, Centralia, Mo.

[21] Appl. No.: 121,781

[22] Filed: Nov. 16, 1987

[51] Int. Cl.[4] ..... H01H 85/14

[52] U.S. Cl. ..... 337/248; 337/252

[58] Field of Search ..... 337/248, 252, 251, 205; 156/69

[56] References Cited

U.S. PATENT DOCUMENTS 4,628,294 12/1986 Parker et al. ..... 337/248

*Primary Examiner*—H. Broome

*Attorney, Agent, or Firm*—Hovey, Williams, Timmons & Collins

[57] ABSTRACT

An end cap connection assembly for use in connecting the metallic end caps of an electrical device such as current limiting fuses or lightning arrestors to associated insulative housings is provided which gives a strong mechanical bond as well as a leak-proof seal between these components. The connection assembly includes a cap presenting a continuous, annular, generally U-shaped in cross section housing-receiving groove, along with a relatively rigid synthetic resin sealing adhesive contacting both the groove walls and housing. The rigid adhesive is selected to have a heat distortion temperature closely matching that of the housing. Preferably, sealing material also has a thermal coefficient of expansion profile analogous to that of the housing. In this way the overall sealing assembly can successfully resist leakage resulting from thermal cycling. The sealing assembly of the invention completely eliminates the use of conventional O-rings, gaskets or similar expedients.

5 Claims, 3 Drawing Sheets

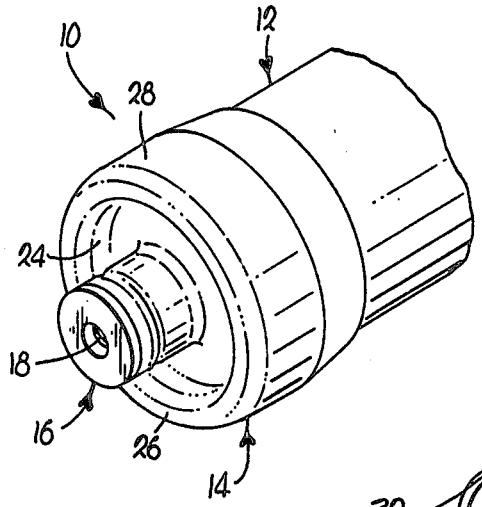
Fig. 1
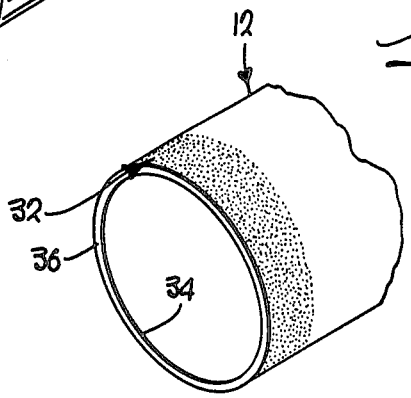
Fig. 2
Fig. 3
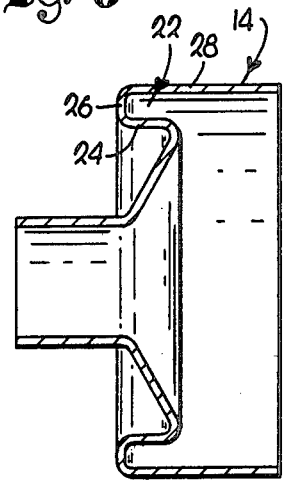
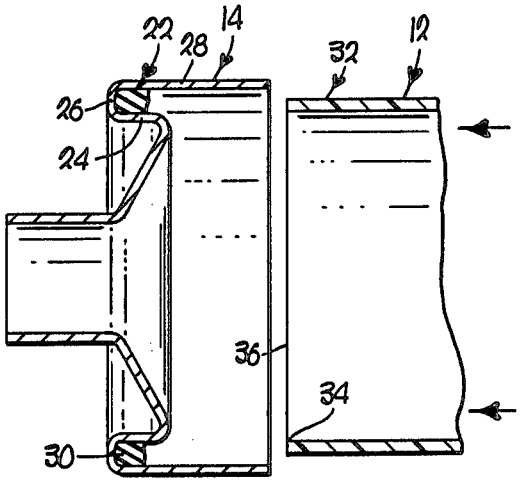
Fig. 4
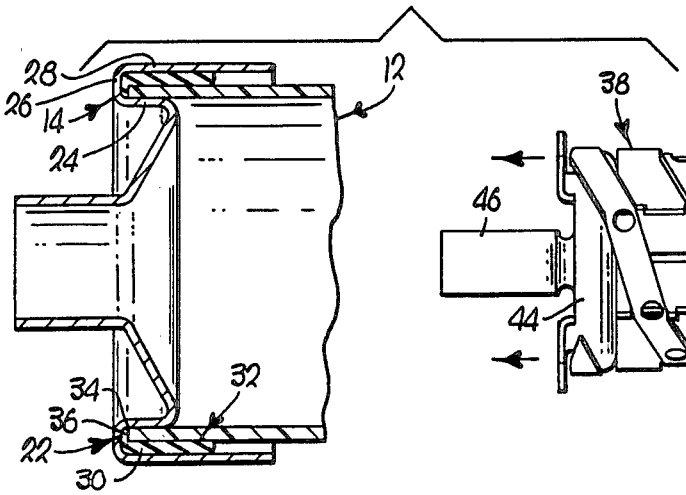
Fig. 5
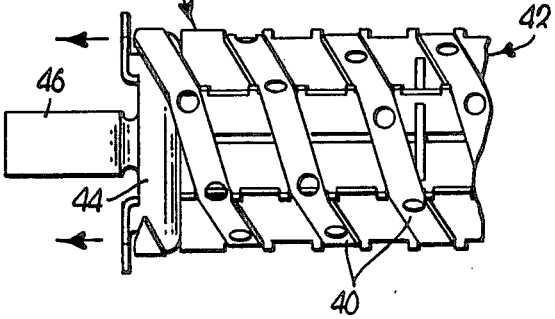

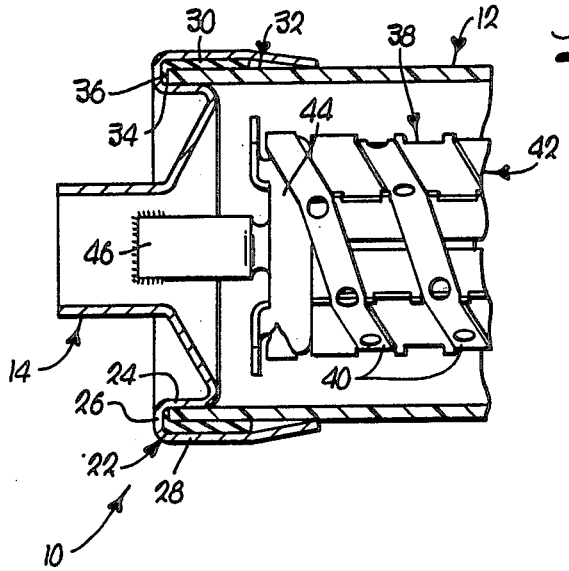
Fig. 6
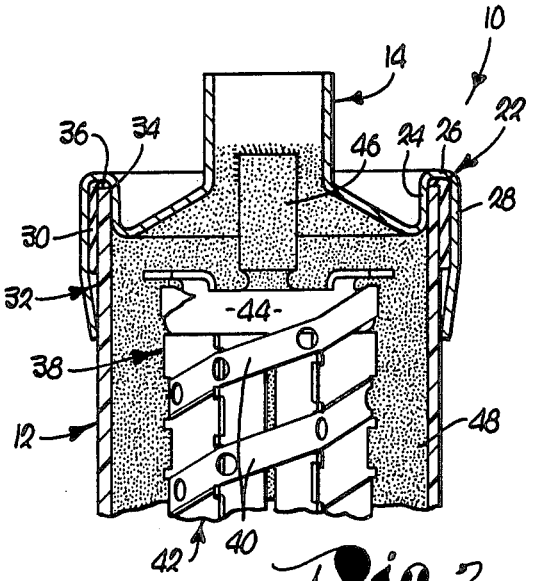
Fig. 7
Fig. 8
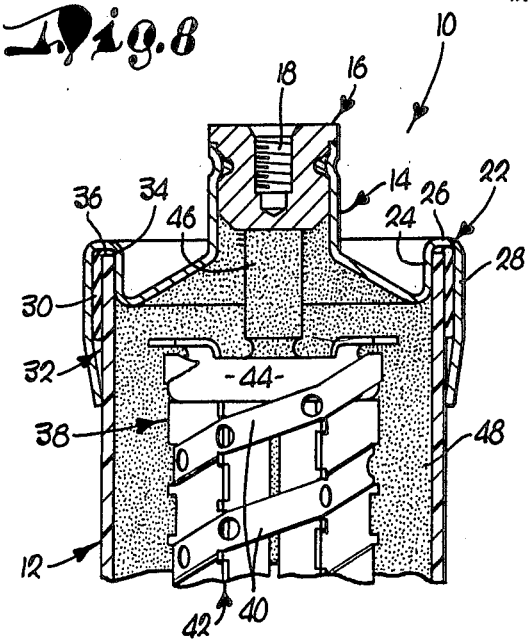
Fig. 9
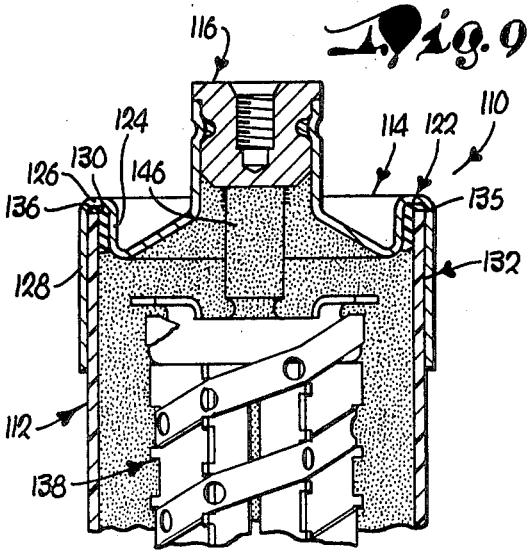

ELECTRICAL DEVICE END CAP CONNECTION ASSEMBLY USING RIGID SEALING MATERIAL

BACKGROUND OF THE INVENTION

1. Field of the Invention

This invention relates to a connection assembly between an electrically insulative tubular member and an electrically conductive end cap, typically in the context of an electrical device such as an oil-submersible current limiting fuse (CLF) or a lightning arrestor. More particularly, it is concerned with such an end cap connection assembly making use of a relatively rigid synthetic resin sealing material between the tubular member and metallic end cap which has a characteristic heat distortion temperature analogous to that of the tubular member. Moreover, the synthetic resin sealing material advantageously exhibits a coefficient of expansion profile similar to that of the tubular housing. In this fashion, the end cap connection assembly provides an effective seal throughout all normal thermal cycling of the elctrical device.

2. Description of the Prior Art

During construction of electrical devices, the securement of insulative tubular members to conductive end pieces or caps has long been a challenge to those in the field. Typically, the end caps are comrised of a metallic material such as copper, aluminum or brass for conducting a current of electricity between an external circuit and an electrical subassembly within the device. On the other hand, the insulative member may be a synthetic resin tube having glass fibers, or alternatively may be comprised of a material such as porcelain or the like.

By way of illustration, current limiting fuses as well as lightning arrestors often include an outer, cylindrical, fiberglass tube with a copper end cap assembly secured to each end of the tube. The end cap assembly commonly has either a lug, a male threaded portion or a threaded bore for releasably fixing an electrical lead to the end cap in order to provide a current path to an electrical subassembly disposed within the insulative tube.

As can be appreciated, it is desirable to provide a means for securely connecting the end cap assembly to the insulative tube to prevent relative movement between the end cap and the insulative tube. During installation, the worker may apply substantial torsional stresses to the assembly as the wire lead is coupled to the end cap in an attempt to preclude subsequent unintentional loosening of the electrical joint. Unfortunately, rotative or axial movement of the cap relative to the tube can irreversibly damage portions of the internal electrical subassembly.

Moreover, such electrical devices are often placed in service in environments which include exposure to fluids. The aforementioned current limiting fuses and lightning arrestors are sometimes immersed in insulating transformer oil within a subgrade or grade level compartment. Alternatively, fuses and lightning arrestors may be mounted atop a utility pole and exposed to rainwater, ice and snow. Consequently, the end cap assembly must sealingly engage the insulating tube in such a manner to enable the device to completely resist the infiltration of fluids over the service life of the device. Moreover, such a seal must not be broken when the device is subject to severe installation stresses.

In the past, a variety of methods have been proposed for securely and sealingly connecting an end cap to an insulative tube. For example, in U.S. Pat. No. 4,063,208 to Bernatt, dated Dec. 13, 1977, an end portion of an insulating tube is provided with a first recess for receiving an O-ring, and a somewhat cup-shaped metallic end piece is mounted over the tube end portion to engage the O-ring. Portions of the end cap are magneformed inwardly to engage the tube in the vicinity of a second tube recess. However, expensive tooling is required to form such recesses, and the tube end portions are weakened somewhat unless the thickness of the tube is increased to provide additional strength. Moreover, the O-ring functions only as a seal and does not contribute to the overall strength of the connection.

U.S. Pat. No. 4,146,862 to Mikulecky, dated Mar. 27, 1979, discloses a connection between an end cap assembly and an insulating tube wherein a gasket having a rounded outermost lip is placed partially within the tube and the latter is inserted into an end cap until the rounded lip is positioned within an annular, epoxy containing groove formed in the end cap. Unfortunately, such construction requires the use of a gasket, thereby raising the costs of the parts and the amount of labor needed for assembly.

Additionally, when the insulating tube is comprised of glass fibers, it is important to prevent fluid from entering the device along leak paths parallel to the disposition of the fibers. During manufacturing of the tube, some of the fibers are sometimes not completely sealed and when the tube is cut to length, breakage of the fiber strands creates additional openings for possible subsequent fluid entry. Accordingly, it is preferable that the ends of fiberglass tubes are completely sealed so that the usable life of the electrical device is not unnecessarily shortened.

SUMMARY OF THE INVENTION

The present invention overcomes the above-noted disadvantages by provision of a novel end cap connection assembly useful in the context of electrical devices such as CLF's or lightning arrestors. The connection assembly has sufficient strength to withstand severe torsional stresses during installation and also provides a seal to substantially preclude the entry of fluids over the lifetime of the device, whether the latter is placed in service in outdoor locations or immersed within a tank of transformer oil. Furhtermore, the connection assembly sucessfully resists leakage during thermal expansion and contraction cycling of the electrical device.

More particularly, the end cap connection assembly of the invention is useful in the context of an electrical device including a housing presenting an end wall portion circumscribing an end opening. The end wall portion has a characteristic heat distortion temperature, as measured by ASTM test D-648 (the published details of this test are incorporated by reference herein). The connection assembly has an end cap (typically of metallic construction) adapted to fit over the end wall portion of the housing to cover the opening, with the cap including a peripheral section including walls defining a continuous, generally U-shaped in cross section channel for receiving the housing end wall portion. A sealing material is located within the continuous channel for creating a leak-proof seal between the end cap and housing end wall portion. This sealing material comprises a cured synthetic resin system having a heat distortion temperature (measured by the aforementioned ASTM test D-648) which is at least about 85% of the heat distortion temperature of the housing end wall portion. More particularly, the sealing resin system should have a heat distortion temperature which is from about 85 to 115% of that of the housing end wall portion; and in the presently preferred embodiments, the heat distortion temperature of the resin system is in excess of that of the housing end wall portion.

Advantageously, the end wall portion of the tube has an outer 90° butt edge configured to engage a portion of the end cap channel-defining walls at a position spaced from the bottom of the rounded channel, such that the curved channel walls prevent the end of the tube from flush engagement with the channel bottom. As a result, this mechanical interference creates and preserves a space for sufficient contact of the sealing material with the end of the tube to substantially preclude fluid entry along pathways adjacent broken fiberglass strands.

In preferred forms of the invention, the housing tube and end cap have a generally circular configuration, and the end cap has walls extending outwardly from the channel in initially parallel disposition to the tube as the latter is inserted within the channel. Subsequently, the outwardly-extending end cap walls are magneformed radially inward to a position adjacent the tube and a portion of the sealing material is thereby compressed between the end cap walls and the end portion of the tube. Thus, during subsequent thermal expansion and contraction of the device, the magneformed cap walls prestress the sealing material toward a configuration to relieve tensile stresses between the sealing material and the tube end portion, and consequently an effective, fluid-resistant seal is maintained.

The sealing material comprises a castable synthetic resin adhesive that cures to a state capable of bonding a variety of materials while maintaining an effective seal. The adhesive has an elevated temperature strength, a high heat distortion temperature, and a thermal coefficient of expansion profile similar to that of the fuse tube thereby providing outstanding strength and bondability properties while maintaining a fluid resistant seal regardless of subsequent thermal expansion and contraction of the tube, end cap and adhesive. As a result, the adhesive, in combination with the walls of the end cap, provide both a stress resistant connection as well as an effective fluid-resistant seal without the use of separate gaskets or other components.

BRIEF DESCRIPTION OF THE DRAWINGS

FIG. 1 is a perspective, fragmentary view of the end cap assembly according to one embodiment of the invention, wherein an end cap has walls that are magneformed to engage an insulating tube of a current limiting fuse;

FIG. 2 is a perspective, fragmentary view of the tube shown in FIG. 1 before assembly, wherein an end portion of the tube is roughened to enhance the bond between an adhesive and the tube;

FIG. 3 is an enlarged, cross-sectional view of the end cap shown in FIG. 1 with the electrical lead engaging insert removed for clarity;

FIG. 4 is an enlarged, fragmentary, side cross-sectional view of the end cap and fuse tube shown in FIG. 1 before assembly, wherein a quantity of a synthetic resin adhesive is placed within a generally U-shaped channel of the end cap;

FIG. 5 is a view similar to FIG. 4 wherein the end portion of the fuse tube has been inserted within the channel of the end cap, and the adhesive sealant is displaced to engage the sidewalls of the fuse tube as well as the end of the latter, this figure also showing a fragmentary, side elevational view of a fusible element internal subassembly that is positioned within the fuse tube;

FIG. 6 is an enlarged, fragmentary, cross-sectional view similar to FIG. 5, wherein wall portions of the end cap are magneformed inwardly to prestress the synthetic resin adhesive sealant after the latter has cured, and the fusible assembly is brazed to walls of the end cap;

FIG. 7 is an enlarged, fragmentary, cross-sectional illustration similar to FIG. 6 wherein a quantity of sand has been added to internal areas of the fuse;

FIG. 8 is a fragmentary, enlarged, side cross-sectional view similar to FIG. 7, wherein assembly of the current limiting fuse is completed by installation of a generally cylindrical, copper insert having a threaded bore for coupling the device to a lug of an external circuit lead;

FIG. 9 is a fragmentary, enlarged, side cross-sectional view of an assembled current limiting fuse according to a second embodiment of the invention;

DETAILED DESCRIPTION OF THE DRAWINGS

Figure 10:
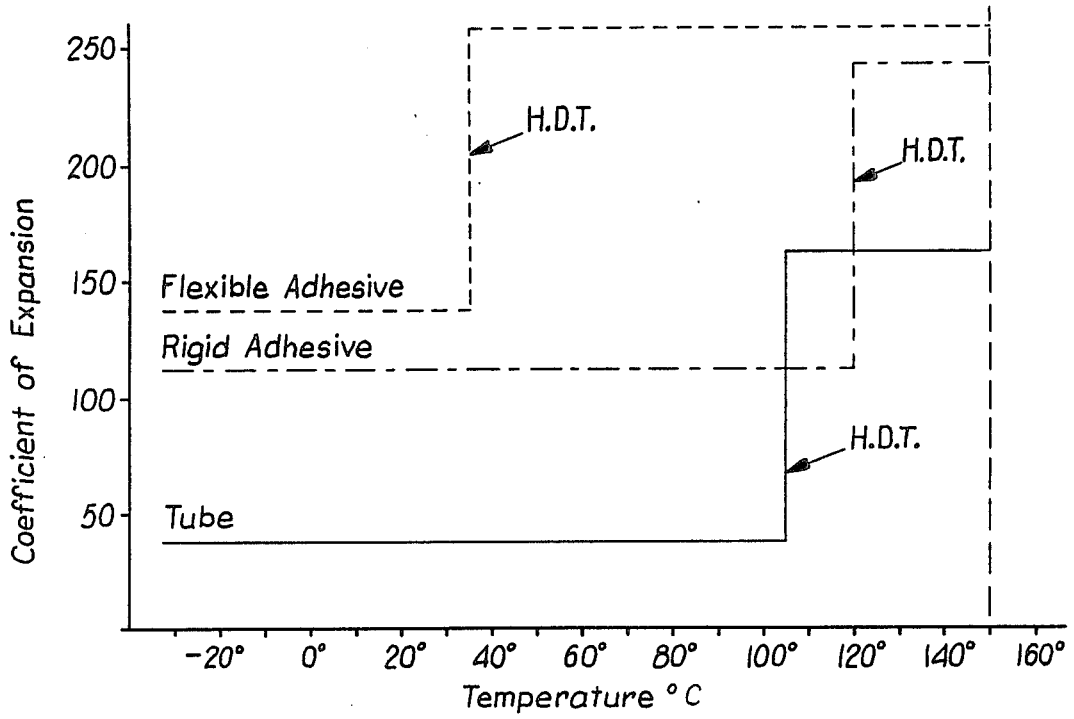
FIG. 10 is a graph illustrating the coefficients of expansion and the heat distortion temperatures of the housing tube, the preferred rigid adhesive sealant in accordance with the invention, and a flexible adhesive sealant found to give unacceptable sealing results.

The end cap connection of a fluid-resistant electrical device is shown in FIGS. 1–9 as adapted for use with a current limiting fuse assembly 10, 110. However, it is contemplated that the principles of the present invention may be successfully employed wherever an insulative tube is to be joined to a conductive end cap, as may be provided for other electrical devices such as lightning arrestors.

Referring initially to the embodiment depicted in FIGS. 1–8, FIG. 1 illustrates an electrical device or current limiting fuse 10 having a hollow, cylindrical, electrically insulative tubular member or fuse tube 12 that optionally is formed with strands of glass fiber. The fuse 10 also includes a generally cylindrical, electrically conductive end piece or cap 14, preferably comprised of a metallic material such as copper, aluminum or brass, and having a shouldered insert 16 (see also FIG. 8) with a threaded bore 18 for reception of a bolt (not shown) adapted to releasably and electrically fix a lug of an external electrical lead to the end cap 14.

As viewed in FIGS. 2–8, the end cap 14 has a generally U-shaped annular channel 22 defined by a cylindrical inner wall 24, a curved bottom 26 and an initially cylindrical outer wall 28. As shown in FIG. 4, a quantity of initially flowable sealing material 30, to be described in more detail hereinafter, is disposed within the channel 22.

During assembly, an end portion 32 of the fuse tube 12 is roughened as shown in FIG. 2 to enhance adhesion between the portion 32 and the sealing material 30. Moreover, the inner diameter of the fuse tube 12 is approximately equal to the outer diameter of the end cap inner wall 24, and the end portion 32 presents an end 36 with an inner edge 34 having a generally 90° configuration in transverse cross-section.

As the fuse tube 12 is shifted in the direction of the arrows shown in FIG. 4, the edge 34 engages the inner wall 24 and simultaneously the end portion 32 displaces a portion of the sealing material 30 until the latter assumes generally the L-shaped configuration illustrated in FIG. 5. The edge 34 slides along the wall 24 as the tube 12 is inserted into the channel 22, until the edge 34 contacts the curved walls comprising the channel bottom 26. Since the diameter of the edge 34 is substantially equal to the outer diameter of the inner wall 24, the tube end portion 32 comes to rest at a position such that the end 36 of the tube 12 is spaced from the bottom 26.

As such, the sharply cornered edge 34, in combination with the curved bottom 26, cooperate to maintain the end portion 32 of the tube 12 in spaced disposition from the bottom 26 to enable the sealng material 30 to fully contact the end 36 of the tube 12. Such construction is particularly advantageous when the fuse tube 12 is comprised of stranded material such as fiberglass, as the end 36 may be cut during manufacture, exposing broken strands and possibly creating pathways for leakage of fluids in the absence of use of the method for making the end cap connection as disclosed herein.

Viewing FIG. 5, an internal subassembly 38 includes a pair of fusible elements 40 which are wrapped around a support assembly 42 and secured to a terminal bracket 44 having an outwardly-extending tab 46 (if desired, only a single element could be employed). The subassembly 38 is shifted in the direction of the arrows shown in FIG. 5 to a position within the tube 12 as depicted in FIG. 6, whereupon the tab 46 is brazed to an area of the end cap 14.

Subsequently, the sealing material 30 is cured to a hardened condition, and next an outer portion of the wall 28 is magneformed to shift the later in a radially inward direction toward a position of contact with the fuse tube 12. At the same time, the magneforming operation somewhat inwardly moves the remaining portions of the outer wall 28, such that the cured sealing material 30 is compressed between the walls 28 and the end portion 32 of the tube 12. The sharp edge 34 of the tube 12, in combination with the curved bottom 26, enables the cap 14 to support the tube 12 during magneforming of the latter and provide beam strength.

Compression of the sealing material 30 between the wall 28 and the end portion 32 consequently prestresses the sealing material 30 for enhancement of the fluid-resistant characteristics of the connection during subsequent thermal excursions. For example, if the thermal coefficient of expansion of the tube 12 significantly differs from the coefficient of expansion for the sealing material 30, the end portion 32 might excessively contract and pull away from the material 30 at low temperatures, thus endangering the bond between the material 30 and the end portion 32. However, prestressing of the sealing material 30, by such magneforming of the wall 28, enables the material 30 to be placed in compression and thereby at least partially relieve tensile stresses between the material 30 and the end portion 32.

As illustrated in FIG. 7, a quantity of sand 48 is next disposed within the interior portions of the fuse 10 to serve as a support for the subassembly 38 as well as provide an arc extinguishing means should the elements 40 rupture. Finally, as shown in FIG. 8, the insert 16 is positioned within a cylindrical, central portion of the end cap 14 to thereby complete sealing of the fuse 10.

The foregoing description of the structure of current limiting fuses in accordance with the invention largely parallels the disclosure of co-pending, co-owned application No. 859,488, filed May 5, 1986, this application being incorporated by reference herein. However, as described in that application, the epoxy sealing material employed was of a relatively flexible nature. It was believed that such material would provide the most effective seal in that it could, theoretically at least, flex with the tube and end cap during thermal cycling. Actual results with the relatively flexible sealing material have proved, however, that such material is prone to leakage during the temperature extremes encountered in use. This is particularly the case in applications where the fuse is submerged under oil.

In accordance with the present invention, it has now been determined that, contrary to the initial belief, a relatively rigid sealing material provides the most effective seal between the housing tube and end cap, so long as the heat distortion temperature of the cured synthetic resin sealing system is at least about 85% of the heat distortion temperature of the adjacent end wall portion of the housing tube. This is a surprising result inasmuch as the conventional wisdom of the art teaches the use of flexibilized sealants in this context.

The presently preferred adhesive/sealing material 30 includes 200 parts by weight of diglycidyl ether of bisphenol A (Epon 828 sold by Shell Chemical Co.), together with 70 parts of a modified polyamide hardener (HT939 sold by Ciba-Geigy). The composition further includes aluminum powder at a level of 50 parts by weight for decreasing the material's coefficient of expansion, 3 parts by weight of colloidal silica particles sintered together in chain-like formations (Cab-O-Sil sold by Cabot Corporation) for making the material thixotropic. These materials are simply admixed in the usual fashion, applied to the joint to be sealed, and allowed to cure. Another suitable sealing material 30 is an aluminum filled, thixotropic, "non sag", epoxy adhesive sold as Uniset A-410-5 by Amicon of Lexington, Mass.

Figure 11:
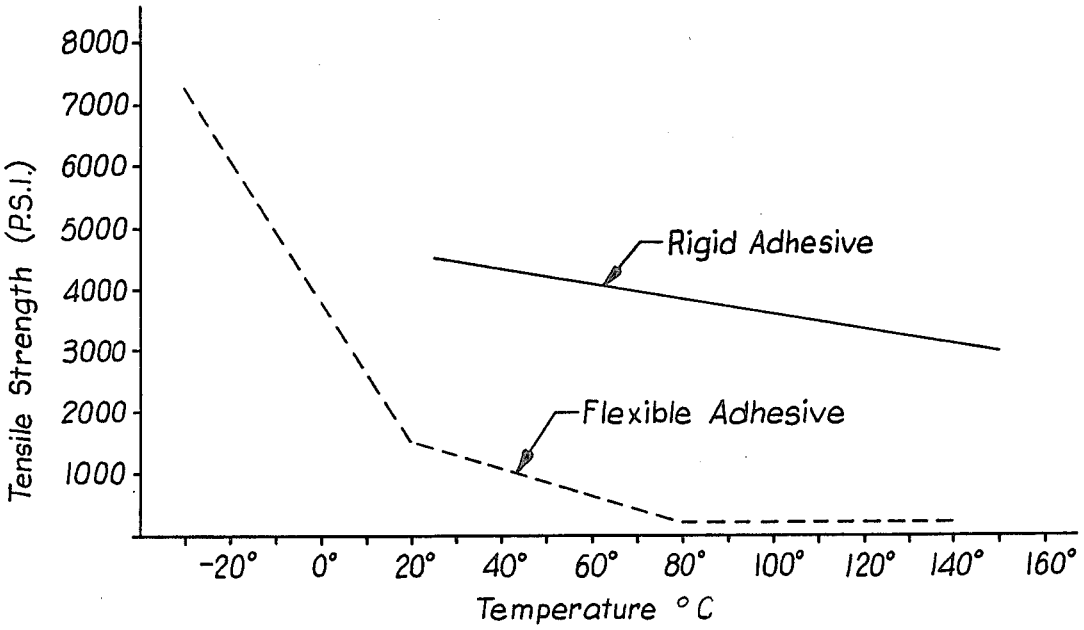
FIG. 11 is a graph of the tensile strengths of the flexible and rigid adhesives referred to in FIG. 10.

Preferably, the aforementioned synthetic resin sealing material 30 is cured at a temperature approximating 150° C., although good results are also obtained whenever the material 30 is cured at a temperature in the range of approximately 120° C. to approximately 175° C. As illustrated in FIG. 10, the heat distortion temperature (HDT) of the relatively rigid synthetic resin adhesive 30 of the present invention is approximately 120° C. which is much closer to the heat distortion temperature of the tube 12 (105° C.) than is the heat distortion temperature of a flexible adhesive (35° C.) disclosed in application Ser. No. 859,488 filed, May 5, 1986. Using an adhesive which has a heat distortion temperature closely matching that of the tube 12, minimizes the expansion differences between the adhesive and the tube thereby minimizing stresses created during temperature changes. Another positive characteristic of the present adhesive 30 is that it has high tensile strengths at high temperatures as compared with flexible adhesives that have low tensile strengths at high temperatures (see FIG. 11). By employing a rigid adhesive 30 which has a heat distortion temperature closely matching that of the tube and which has high tensile strengths at high temperatures, an effective seal can be maintained between adhesive, and cap and tube regardless of temperature changes. Finally, it will be observed (see FIG. 10) that the coefficient of expansion profile of the rigid adhesive of the present invention more closely matches the profile of the tube 10.

FIG. 9 illustrates another embodiment of the present invention wherein an assembled current limiting fuse 110 includes a hollow, cylindrical, electrically insulative fuse tube 112, a conductive end piece or cap 114, an internal subassembly 138 including a tab 146 that is brazed to an area of the end cap 114, and a shouldered, generally cylindrical insert 116 received within an outwardly extending, tubular opening of the end cap 114. Except as noted hereinbelow, the various components of the fuse 110 are substantially similar in configuration and are assembled in somewhat the same fashion as the components described with regard to the fuse 10 shown in FIGS. 1–8.

More particularly, the end cap 114 shown in FIG. 9 has an outer, cylindrical wall 128 with an internal diameter slightly larger than the outer diameter of the tube 112. During assembly of the fuse 110, a quantity of sealing material 130 is placed within a U-shaped channel 122 formed between the outer wall 128, a cylindrical inner wall 124, and a curved bottom 126 interconnecting the walls 124, 128. During assembly of the fuse 110, an outer circular edge 135 of the tube 112 slides along the wall 128 as the tube 112 is inserted into the channel 122, until the edge 135 contacts the curved walls comprising the channel bottom 126. As a result, a tube end portion 132 comes to rest at a position such that an end 136 of the tube 112 is spaced from the bottom 126, since the diameter of the edge 135 is substantially equal to the inner diameter of the outer wall 128.

During insertion of the tube 112 into the end cap 114, the sealing material 130, being initially flowable, is shifted and assumes a generally L-shaped transverse configuration, as shown in FIG. 9. The edge 135, in combination with the curved bottom 126, cooperate to retain the end portion 132 in spaced disposition from the bottom 126 so that the sealing material 130 can fully contact the entire end 136 of the tube 112, as is desired when the latter is comprised of stranded material such as fiberglass.

Subsequently, after installation of the subassembly 138 in similar fashion as described with regard to the subassembly 38 in FIGS. 5–6, the sealing material 130 is cured to a hardened condition. Next, the outer wall 128 is subject to a magneforming operation wherein the wall 128 is shifted in a radially inward direction toward a position of substantially complete contact with the outside surface of the end portion 132. Compression of the wall 128 against the end portion 132 also causes the latter to shift radially inward and compress the sealing material 132 against the inner wall 128, to thereby prestress the sealing material 130 for enhancement of the fluid-resistant characteristics of the connection during subsequent thermal excursions. Next, the synthetic resinous sealing material 130 is cured, preferably at a temperture approximating 150° C.

What is claimed is:

1. An end cap connection assembly for an electrical device including a housing presenting an end wall portion circumscribing an end opening, said end wall portion having a heat distortion temperature, said end cap connection assembly comprising:

an end cap adapted to fit over said end wall portion and cover said opening, said cap having a peripheral section including walls defining a continuous, generally U-shaped in cross-section channel for receiving said end wall portion; and a sealing material within said channel for creating a leakproof seal between the end cap and end wall portion, said sealing material comprising a cured synthetic resin system having a heat distortion temperature which is at least about 85% of said heat distortion temperature of said end wall portion.

2. The end cap connection assembly of claim 1, said sealing material resin system having a heat distortion temperature which is from 85 to 115% of said heat distortion temperature of said end wall portion.

3. The end cap connection assembly of claim 1, said sealing material resin system having a heat distortion temperature which is in excess of said heat distortion temperture of said end wall portion.

4. The end cap connection assembly of claim 1, said end wall portion being formed of fiberglass reinforced epoxy material.

5. The end cap connection assembly of claim 4, said sealing material resin system comprising an epoxy resin system.

* * * * *